US009289807B2

(12) United States Patent
Eckerstorfer et al.

(10) Patent No.: US 9,289,807 B2
(45) Date of Patent: Mar. 22, 2016

(54) ENERGY AND YIELD-OPTIMIZED METHOD AND PLANT FOR PRODUCING HOT STEEL STRIP

(75) Inventors: Gerald Eckerstorfer, Leonding (AT); Gerald Hohenbichler, Kronstorf (AT); Josef Watzinger, Reichenau (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 0 days.

(21) Appl. No.: 13/877,429

(22) PCT Filed: Oct. 10, 2011

(86) PCT No.: PCT/EP2011/067623
§ 371 (c)(1), (2), (4) Date: Apr. 2, 2013

(87) PCT Pub. No.: WO2012/049107
PCT Pub. Date: Apr. 19, 2012

(65) Prior Publication Data

US 2013/0186588 A1 Jul. 25, 2013

(30) Foreign Application Priority Data

Oct. 12, 2010 (EP) ..... 10187209

(51) Int. Cl.
*B21B 1/46* (2006.01)
*B22D 11/041* (2006.01)
(Continued)

(52) U.S. Cl.
CPC ..... *B21B 1/463* (2013.01); *B22D 11/041* (2013.01); *B22D 11/043* (2013.01);
(Continued)

(58) Field of Classification Search
CPC ..... B21B 1/46; B21B 1/463; B22D 11/00; B22D 11/04; B22D 11/12; B22D 11/1213; B22D 11/122; B22D 11/1284; B22D 11/14; B22D 11/143
USPC ..... 164/441, 447, 484, 460, 476, 417, 477
See application file for complete search history.

(56) References Cited

U.S. PATENT DOCUMENTS 4,335,780 A * 6/1982 Burkhard ..... 164/441
4,872,946 A * 10/1989 Uesugi et al. ..... 205/139
(Continued)

FOREIGN PATENT DOCUMENTS

AU 624831 B2 6/1992 ..... B21B 1/46
CN 1292847 4/2001
(Continued)

OTHER PUBLICATIONS

Shore, R. et al., "Casting Technology and Machine Design Solutions for ESP Plants," Rolling & Processing Conference 2008, Paper No. 5.3, 10 pages, Sep. 16, 2008.
(Continued)

*Primary Examiner* — Kevin P Kerns
*Assistant Examiner* — Steven Ha
(74) *Attorney, Agent, or Firm* — Ostrolenk Faber LLP

(57) ABSTRACT

A method is disclosed for continuously or semi-continuously producing hot steel strip which, starting from a slab guided through a slab-guiding device, is rolled in, for example, an at least four-stand roughing train to form an intermediate strip and, in a further sequence in a finish rolling train, into a final strip. The thickness of a slab cast in a die is reduced in the liquid core reduction process by means of the adjoining slab-guiding device to between 85 and 120 mm, a slab support length measured between the meniscus, i.e., the bath level, of the die and an end of the slab-guiding device facing the roughing train being at least 18.5 m, a casting speed ranging from 3.8 to 7 m/min, and slabs of different thicknesses being cast as a function of given casting speeds. Using the disclosed casting parameters, high-quality finishing may be provided with high production capacities.

23 Claims, 5 Drawing Sheets

(51) Int. Cl.

| | |
|---|---|
| ***B22D 11/043*** | (2006.01) |
| ***B22D 11/12*** | (2006.01) |
| ***B22D 11/128*** | (2006.01) |
| ***B22D 11/14*** | (2006.01) |
| ***B22D 11/22*** | (2006.01) |
| ***B22D 11/124*** | (2006.01) |

(52) U.S. Cl.
CPC ..... *B22D 11/1206* (2013.01); *B22D 11/1246* (2013.01); *B22D 11/1282* (2013.01); *B22D 11/142* (2013.01); *B22D 11/225* (2013.01)

(56) References Cited

U.S. PATENT DOCUMENTS

| | | | | |
|---|---|---|---|---|
| 5,991,991 | A | 11/1999 | Pleschiutschnigg | 29/33 |
| 6,092,586 | A | 7/2000 | Schonbeck | 164/476 |
| 6,536,505 | B1 * | 3/2003 | Pleschiutschnigg | 164/417 |
| 6,543,137 | B1 | 4/2003 | Noller et al. | 29/890.124 |
| 7,854,884 | B2 | 12/2010 | Schuster et al. | 266/114 |
| 8,327,918 | B2 | 12/2012 | Seidel et al. | 164/454 |
| 2008/0035301 | A1 | 2/2008 | Arvedi | 164/460 |
| 2008/0276679 | A1 * | 11/2008 | Eckerstorfer et al. | 72/38 |
| 2013/0186588 | A1 | 7/2013 | Eckerstorfer et al. | 164/463 |
| 2013/0192790 | A1 | 8/2013 | Eckerstorfer et al. | 164/455 |

FOREIGN PATENT DOCUMENTS

| | | | | |
|---|---|---|---|---|
| CN | 1103647 | | 3/2003 | |
| CN | 1840252 | | 10/2006 | |
| DE | 19639302 | A1 | 3/1998 | B22D 11/04 |
| DE | 10025080 | A1 | 5/2001 | B21B 1/46 |
| DE | 102007058709 | A1 | 2/2009 | B21B 37/74 |
| EP | 0415897 | B1 | 2/1994 | H04B 1/10 |
| EP | 0889762 | B1 | 10/1999 | B21B 1/00 |
| EP | 0415987 | B2 | 11/1999 | B21B 1/46 |
| EP | 1059125 | | 6/2000 | |
| EP | 1 870 172 | | 12/2007 | |
| EP | 1469954 | B2 | 3/2009 | B21B 1/26 |
| RU | 2166387 | C2 | 5/2001 | |
| RU | 2393034 | C2 | 6/2010 | |
| WO | WO 2007/045988 | | 4/2007 | |
| WO | 2007/086088 | A1 | 8/2007 | C21C 8/00 |
| WO | WO 2009/018957 | | 2/2009 | |
| WO | 2012/049107 | A1 | 4/2012 | B21B 1/463 |
| WO | 2012/049135 | A1 | 4/2012 | B21B 1/46 |

OTHER PUBLICATIONS

Siegl, J., "Arvedi ESP—Endless Strip Production, First Thin Slab Endless Casting and Rolling," 5th European Rolling Conference, London, 13 pages, Jun. 23, 2009.

Hochenbichler, Gerald et al., "Arvedi ESP—Technology and Plant Design," Millenium Steel 2010, URL: http://www.millennium-steel.com/articles/pdf/2010/pp82-88%20MS10.pdf, 7 pages, Mar. 1, 2010.

Arvedi, Giovanni, "Achievements of ISP Steelmaking Technology," Ironmaking and Steelmaking, vol. 37, No. 4, 6 pages, May 1, 2010.

Arvedi, G. et al., "Arvedi ESP First Thin Slab Endless Casting and Rolling Results," Ironmaking and Steelmaking, vol. 37, No. 4, 5 pages, May 1, 2010.

International Search Report, Application No. PCT/EP2011/067670, 5 pages, Dec. 16, 2011.

International Search Report, Application No. PCT/EP2011/067623, 5 pages, Dec. 27, 2011.

Russian Federation Decision on Grant, dated Oct. 30, 2015, issued in corresponding Russian Patent Application No. 2013120029/02(029633). Total 13 pages.

* cited by examiner

ENERGY AND YIELD-OPTIMIZED METHOD AND PLANT FOR PRODUCING HOT STEEL STRIP

CROSS-REFERENCE TO RELATED APPLICATIONS

This application is a U.S. National Stage Application of International Application No. PCT/EP2011/067623 filed Oct. 10, 2011, which designates the United States of America, and claims priority to EP Patent Application No. 10187209.1 filed Oct. 12, 2010 The contents of which are hereby incorporated by reference in their entirety.

TECHNICAL FIELD

The disclosure relates to a method for continuously or semi-continuously producing hot steel strip which, starting from a slab guided through a slab-guiding device, is rolled in a roughing train to form an intermediate strip and in a further sequence is rolled in a finish rolling train into a final strip, as claimed in claim 1, as well as to a corresponding plant for carrying out this method as claimed in claim 22.

BACKGROUND

A method is described as continuous production or endless rolling if a casting plant is connected to a rolling plant so that the slab cast in the die of a casting plant is fed directly—without being separated from the slab section just cast and without intermediate storage—into a rolling plant and is rolled there to a desired final thickness in each case. The beginning of the slab can thus already be rolled to its finished final thickness while the casting plant continues to cast the same slab, i.e. no end of the slab exists at all. This is also referred to as directly-coupled operation or endless operation of the casting and rolling plant.

In semi-continuous production or "semi-endless rolling" the cast slabs are separated after casting and the separated slabs are fed to the rolling plant without intermediate storage and cooling to ambient temperature.

The slab emerging from the die of the casting plant first passes through a slab-guiding device located immediately after the die. The slab-guiding device, also referred to as the "slab-guiding corset" comprises a number (usually three to six) guide segments, wherein each guide segment has one or more (usually three to ten) pairs of guide elements, preferably designed as slab support rollers. The support rollers are rotatable around an axis running orthogonally to the direction of transport of the slab.

Instead of being designed as slab-support rollers, individual guide elements can also be designed as static, e.g. skid-shaped components.

Regardless of the actual design of the guide elements, said elements are disposed on both sides of the slab width sides, so that the slab is guided by a series of upper and lower guide elements and conveyed to a roughing train.

Viewed in precise terms, the slab is not only supported by the slab-guiding device but also already by a lower end area of the die, which is why the die could also be seen as a part of the slab-guiding device.

The slab solidification begins at the upper end of the (through) die at the bath surface, the so-called "meniscus", wherein the die is typically around 1 m long (0.3-1.5 m).

The slab emerges vertically downwards out of the die and is diverted into the horizontal. The slab-guiding device therefore essentially has a curved course over an angular range of 90°.

The slab emerging from the slab-guiding device is reduced in thickness in the roughing train (HRM, High-Reduction Mill), the intermediate strip produced here is heated up by a heating device and rolling is completed in a finish rolling train. In the finish rolling train the metal is hot-rolled, which means that the material to be rolled has a temperature during rolling of greater than its recrystallization temperature. With steel this ranges from above around 750° C., usually hot rolling takes place at temperatures of up to 1200° C.

During hot rolling of steel the metal is mostly in the austenitic state, where the iron atoms are disposed cubically face-centered. Rolling is then said to be in the austenitic state when both the starting and the end rolling temperature lie in the austenitic region of the respective steel. The austenitic region of a steel is dependent on the steel composition, but as a rule lies above 800° C.

Decisive parameters in the production process of hot steel strip from combined casting and rolling plants are the casting velocity with which the slab leaves the die (and passes through the slab-guiding device) as well as the mass throughput or volume flow, which is specified as the product of the casting velocity and the thickness of the slab and is usually expressed as the unit [mm*m/min].

The produced steel strips are further processed for motor vehicles, domestic appliances and the building industry.

The continuous and semi-continuous production of hot steel strips is already known from the prior art. As a result of the coupling of casting plant and rolling plant, dealing with all the plant parameters represents a high demand in process technology terms. Modifications in the casting and rolling process, especially through changes in the casting velocity in combination with the slab thickness, as well as a material-specific solidification coefficient which is able to be controlled by cooling, have a significant effect on the production quality and energy efficiency of the plant.

Generic methods or plants are known for example from EP 0 415 987 B1, EP 1 469 954 B1 and DE 10 2007 058 709 A1 and WO 2007/086088 A1.

Significant progress in hot rolling technology has been achieved in particular by Acciaieria Arvedi S.p.A. which has developed a thin slab endless method based on an ISP (In-line Strip Production) technology called Arvedi ESP (Endless Strip Production).

In this ESP method the casting and the rolling process are linked to each other in an especially advantageous manner so that a subsequent cold rolling is no longer required for many hot rolled steel qualities. With such hot rolled steel qualities, in which subsequent cold rolling continues to be required, the number of rolling stands can be reduced compared to conventional rolling trains.

An ESP plant disclosed for example at the Rolling & Processing Conference '08 (September) and installed in Cremona, Italy, for hot-rolled steel production operated by Arvedi, comprises a roughing train connected after the slab casting plant with three roughing stands, two strip separation facilities, an induction oven for intermediate heating of the rough-rolled intermediate strip followed by a finish rolling train with five finishing rolling stands. The endless strip emerging from the roughing train is cooled in a cooling section and wound by means of three underfloor coilers into strip rolls with a weight of up to 32 tons. Positioned before the underfloor coilers is a separation facility in the form of a rapid-cut shear. Depending on the steel types and the strength of the rolled steel strip, the production capacity of this single-Strand production line is around 2 million tons per year (mtpy). This plant is also described to some extent in the following publications: Hohenbichler et al: "Arvedi ESP— technology and plant design", Millenium Steel 2010, Mar. 1, 2010, pages 82-88, London, and Siegl et al: "Arvedi ESP—First Tin Slab Endless Casting and Rolling Results", 5th European Rolling Conference, London, Jun. 23, 2009.

However a particular disadvantage proves to be a 17 m slab support length, which is too short, that is any distance described more precisely as the "metallurgical length", between the casting area of the die, in more precise terms between the bath level of the liquid steel referred to as the "meniscus" and the end of the slab-guiding device facing towards the roughing train.

As already described at the outset, the slab-guiding device forms a partly curved receiving shaft between the guide elements or the slab support rollers to accommodate the freshly cast slab (still having a liquid core).

Thus, in the present context, the active guide surface or outer line of the last guide element facing towards the roughing train or of the last support roller of the upper guide element series is to be understood as the end of the slab-guiding device.

As the distance from the meniscus increases, the slab guided in the slab-guiding device or the steel strip which is in its initial form cools down more and more. Each inner area of the slab, which is still liquid or is of a doughy-soggy consistency, is referred to below as the liquidus tip. A "liquidus tip" further from the die of the liquidus is defined as that central cross-sectional area of the slab in which the temperature just still corresponds essentially to the steel solidus temperature and subsequently falls below this. The temperature of the liquidus tip therefore corresponds to the solidus temperature of the respective sort of steel (typically between 1300° C. and 1535° C.)

The rolling of a completely solidified or cooler cast slab demands a significantly higher energy outlay than the rolling of a cast slab with a hot cross-sectional core.

For volume flows below 380-400 mm*m/min there has previously only been discontinuous production (batch operation) in the ISP or ESP method.

The CSP (Compact Strip Production) methods known from the prior art likewise operate at slab thicknesses of 45-65 mm with volume flows below around 400 mm*m/min using a roller hearth furnace with a length of 250 m and greater, wherein exclusively discontinuous manufacturing (batch operation) or semi-continuous manufacturing takes place. In the latter 3-6 separate slabs (no longer connected to the casting plant or the die) are rolled endlessly.

In EP 0 889 762 B1, for endless casting and rolling of a hot strip, a volume flow>0.487 $mm^2$/min (converted to the conventional unit mentioned at the start: >487 mm*m/min) is proposed. Casting with such a high volume flow with comparatively small slab thickness however proves to be too fast for many sorts of steel to enable a sufficient manufacturing quality to be guaranteed.

SUMMARY

One embodiment provides a method for continuous or semi-continuous production of hot steel strip which, starting from a slab guided through a slab-guiding device, is rolled in a roughing train to an intermediate strip and in a further sequence in a finish rolling train is rolled to a final strip, wherein a slab cast in a die of a casting plant has a slab thickness of between 105 and 130 mm, e.g., a slab thickness of between 115 and 125 mm, and is reduced in a Liquid Core Reduction method by means of the subsequent slab-guiding device with a liquid cross-sectional core of the slab to a slab thickness of between 85 and 120 mm, e.g., to a slab thickness of between 95 and 115 mm, wherein a slab support length measured between an end of the slab-guiding device facing the meniscus, i.e. the bath level of the die and the roughing train, amounts to greater than or equal to 18.5 m, e.g., lies in a range between 18.7 and 23 m, especially e.g., between 20.1 and 23 m, wherein a casting velocity lies in a range of 3.8-7 m/min and wherein slabs with different slab thicknesses are cast as a function of the following casting velocities: for casting velocities between 3.8 and 5.0 m/min with 100-120 mm slab thickness, e.g., with 110 to 120 mm slab thickness, for casting velocities between 5.0 and 5.9 m/min with 85-110 mm slab thickness, e.g., with 95 to 110 mm slab thickness, and for casting velocities greater than or equal to 5.9 m/min with maximum 102 mm slab thickness.

In a further embodiment, in the roughing train a roughing of the slab into an intermediate slab is undertaken in at least four rolling passes, i.e. using four roughing stands, e.g., in five rolling passes, i.e. using five roughing stands.

In a further embodiment, the rolling passes carried out in the roughing train occur within a period of at most 80 seconds, e.g., within at most 50 seconds.

In a further embodiment, the first rolling pass in the roughing train occurs within at most 7 minutes, e.g., within at most 6.2 minutes from the start of solidification of the liquid slab present in the die.

In a further embodiment, between the end of the slab-guiding device and an entry area of the roughing train only cooling of the slab resulting from an ambient temperature is allowed.

In a further embodiment, in the roughing train there is a reduction of the thickness of the slab by 35-60%, e.g., by 40-55% per rolling pass.

In a further embodiment, the intermediate strip emerging from the roughing train is cooled at a cooling rate of a maximum of 3 K/m, e.g., at a cooling rate of a maximum of 2.5 K/m.

In a further embodiment, the intermediate strip emerging from the roughing train is heated by means of an inductive heating device, e.g., using the cross field heating method, starting at a temperature above 770° C., e.g., above 820° C., to a temperature of at least 1110° C., e.g., to a temperature of above 1170° C.

In a further embodiment, the intermediate strip is heated up within a period of 4 to 25 seconds, e.g., within a period of 5 to 13 seconds.

In a further embodiment, when precisely four rolling passes are performed in the roughing train, there is provision for the elapsed time between the first rolling pass and the entry into the heating device for intermediate strip thicknesses of 5-10 mm, not to amount to longer than 105 seconds, e.g., not longer than 70 seconds.

In a further embodiment, the heated intermediate strip is finished in the finish rolling train in four rolling passes, i.e. using four finishing stands or in five rolling passes, i.e. using five finishing stands to a final strip with a thickness<1.5 mm, e.g., <1.2 mm.

In a further embodiment, the rolling passes carried out within the finish rolling train occur within a period of a maximum of 16 seconds, e.g., within a period of a maximum of 8 seconds.

In a further embodiment, for LCR thickness reduction of slab, predefined guide elements of the slab-guiding device are adjustable relative to the longitudinal axis of the slab for making contact with the slab, wherein the guide elements are adjusted as a function of the material of the slab and/or of the casting velocity.

In a further embodiment, the slab thickness is able to be adjusted quasi-statically after the beginning of a casting sequence, i.e. shortly after the slab emerges from the die.

In a further embodiment, the slab width is dynamically adjustable, i.e. able to be varied by any given amount during the casting process or during the passage of the slab through the slab-guiding device.

In a further embodiment, for hard-to-cool slab steels by means of a spray device in the area of the slab-guiding device 6, i.e. by applying 3 to 4 liters of coolant per kg of slab steel, in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in the corridor range of 42000 to 48900, e.g., in a corridor range of 45500 to 48900, while the speed factor for a slab support length of 23 m, lies in a corridor range of 55200 to 64600, e.g., in a corridor range of 59900 to 64600, wherein to determine casting velocities $v_c$ for plants with slab support lengths lying between the slab support lengths of 17.5 m and 23 m, an interpolation is performed between the previously listed corridor ranges.

In a further embodiment, for slab steels that are medium-hard to cool by means of a spray device in the area of the slab-guiding device, i.e., by application of 2 to 3.5 liters of coolant per kg of slab steel, in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in a corridor range of 39600 to 46500, e.g., in a corridor range of 43050 to 46500, while the speed factor for a slab support length of 23 m lies in a corridor range of 52100 to 61900, e.g., in a corridor range of 57000 to 61900, wherein for determining casting velocities slab thicknesses for plants with slab support lengths lying between the slab support lengths or 17.5 m and 23 m, an interpolation is performed between the previously listed corridor ranges.

In a further embodiment, for soft slab steels to be cooled in the area of the slab-guiding device, i.e. by application of less than 2.2 liters of coolant per kg of slab steel, in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in a corridor range of 37100 to 44100, e.g., in a corridor range of 40600 to 44100, while the speed factor for a slab support lengths of 23 m lies in a corridor range of 48900 to 59000, e.g., in a corridor range of 53950 to 59000, wherein for determining casting velocities slab thicknesses for plants with slab support lengths lying between the slab support lengths of 17.5 m and 23 m, an interpolation is performed between the previously listed corridor ranges.

Another embodiment provides a plant for carrying out a method for continuous or semi-continuous production of hot steel strip as disclosed above, comprising a die, a slab-guiding device downstream thereof, a roughing train downstream thereof, an inductive heating device downstream thereof and a finish rolling train downstream thereof, wherein the slab-guiding device has a series of lower guide elements and a series of upper guide elements disposed in parallel or converging therewith and between the two guide element series a receiving shaft provided for receiving a slab emerging from the die is embodied, which by embodying different distances between opposing guide elements to one another in the transport direction of the slab, is narrowed at least in sections and through this the slab is able to be reduced in thickness, wherein the clear receiving width of the receiving shaft at its input area pointing towards the die, amounts to between 105 and 130 mm, e.g., between 115 and 125 mm, that the receiving shaft at its end pointing towards the roughing train has a clear receiving width corresponding to the slab thickness of the slab of between 85 and 120 mm, e.g., of between 95 and 115 mm, wherein a slab support length measured between the meniscus, i.e., the bath level of the die and the end of the receiving shaft of the slab-guiding device facing towards the roughing train is greater than or equal to 18.5 m, e.g., lies in a range between 18.7 and 23 m, especially e.g., between 20.1 and 23 m, and wherein a control device is provided, by means of which the casting velocity of the slab is able to be kept in a range between 3.8-7 m/min.

In a further embodiment, the roughing train comprises four or five roughing stands.

In a further embodiment, no cooling device is provided between the end of the receiving shaft or of the slab-guiding device and a feed area of the roughing train, but a thermal cover is provided, which at least partly surrounds sections of a conveyor device for the transport of the slab.

In a further embodiment, by means of roughing stands disposed in the roughing train, a reduction of the thickness of the slab by respectively 35-60%, e.g., by respectively 40-55% per roughing stand is able to be undertaken so that an intermediate strip with a thickness of 3 to 15 mm, e.g., with a thickness of 4 to 10 mm is able to be created.

In a further embodiment, the heating device is embodied as an inductive cross-field heating oven, by means of which the slab, starting at a temperature of above 770° C., e.g., of above 820° C., is able to be heated up to a temperature of at least 1110° C., e.g., to a temperature of above 1170° C.

In a further embodiment, the finish rolling train comprises four finishing stands or five finishing stands, by means of which an intermediate strip emerging from the roughing train is able to be reduced to a final strip with a thickness<1.5 mm, e.g., <1.2 mm.

In a further embodiment, the finishing stands are each disposed at distances of <7 m, e.g., at distances of <5 m from one another, wherein the distances are measured between the working roller axes.

In a further embodiment, for reducing the thickness of the slab, specific guide elements are adjustable and through this a clear receiving width of the receiving shaft is able to be reduced or enlarged, wherein the slab thickness or the clear receiving width is able to be adjusted as a function of the material of the slab and/or of the casting velocity.

In a further embodiment, the adjustable guide elements are disposed in a front half, e.g., in a front quarter, of the longitudinal extent of the slab-guiding device facing towards the die.

In a further embodiment, a working roller axis of the first roughing stand of the roughing train closest to the slab-guiding device is disposed at a maximum of 7 m, e.g., at a maximum of 5 m after the end of the slab-guiding device.

In a further embodiment, an entry end of the heating device facing towards the roughing train, is disposed at a maximum of 25 m, e.g., at a maximum of 19 m after the operating roller axis of the roughing stand closest to the heating device.

DETAILED DESCRIPTION

Figure 1:
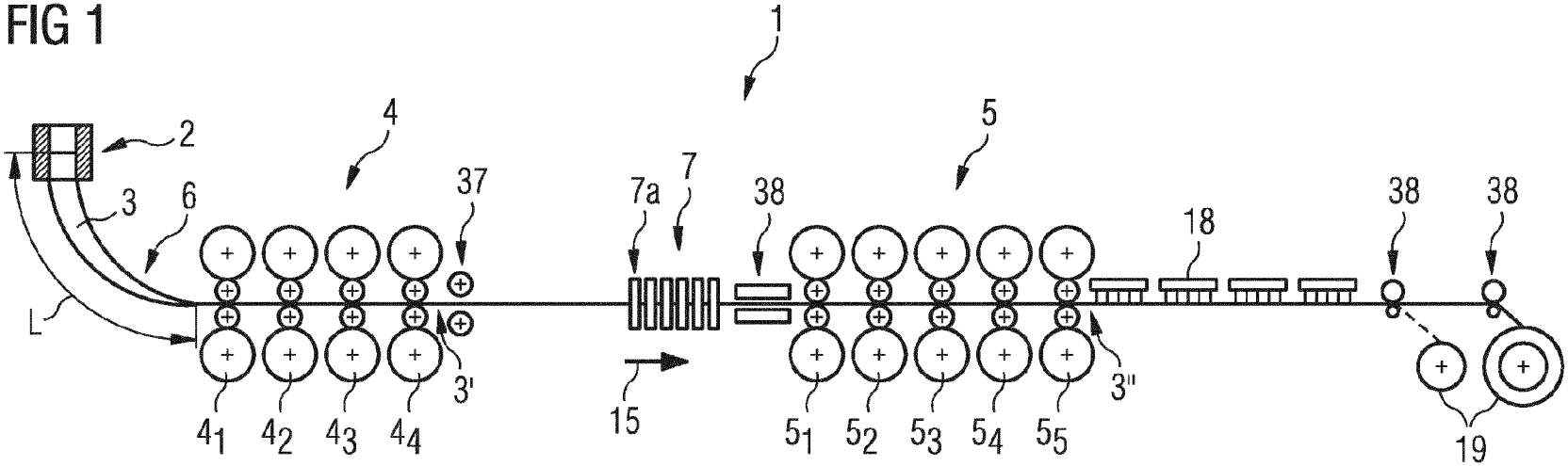
FIG. 1 shows a schematic diagram of a plant for continuous or semi-continuous production of hot steel strip according to an example embodiment, in a view from the side.

As part of increasing cost and manufacturing pressure there is a desire for a capacity increase of the plant with simultaneous further optimization of production of hot steel strip for a plurality of steel qualities, cooling parameters and slab thicknesses.

The energy efficiency of generic plants for production of hot steel strip is also to be increased and more economic production made possible by this method.

In order to utilize the casting heat during the production process of hot steel strip in the optimum way, it is to be guaranteed that the sump peak, i.e. the doughy-liquid cross-sectional core of the slab that is still being transported in the slab-guiding device is always located as far as possible from the die and as close as possible to the end of the slab-guiding device and thus as close as possible to the entry into the roughing train.

In this object account is to be taken of the fact that, as a function of a material-specific solidification factor and a respectively set slab thickness, the casting velocity of the volume flow passing through the slab-guiding device may also not be too great, since in such cases a displacement of the liquidus tip beyond the slab-guiding device and thus a blowing out and bulging of the slab or of the hot steel strip could occur.

The said objects are achieved by a method with the features of claim 1 and by a plant with the features of claim 19.

A method for continuous or semi-continuous production of hot steel strip which, starting from a slab guided by a slab-guiding device, is rolled in a roughing train to an intermediate strip and consequently is rolled in a finish rolling train to a final strip is characterized, in accordance with certain embodiments, that a slab cast in a casting plant has a slab thickness of between 105 and 130 mm, preferably a slab thickness of between 115 and 125 mm, and is reduced in the Liquid Core Reduction (LCR) method by means of the subsequent slab-guiding device with a liquid cross-sectional core of the slab to a thickness of between 85 and 120 mm, preferably to a thickness of between 95 and 115 mm, wherein a slab support length measured between the meniscus, i.e. the casting level of the casting plant and an end of the slab-guiding device facing towards the roughing train is greater than or equal to 18.5 m, preferably lies in a range of between 18.7 and 23 m, especially preferably of between 20.1 and 23 m, and wherein a casting velocity $v_c$ lies in a range of 3.8-7 m/min. In this case the slabs are cast with different slab thicknesses as a function of the following casting velocities:

- at casting velocities of between 3.8 and 5.0 m/min, with 100-120 mm slab thickness, preferably with 110 to 120 mm slab thickness,
- at casting velocities of between 5.0 and 5.9 m/min, with 85-110 mm slab thickness, preferably with 95 to 110 mm slab thickness,
- at casting velocities of greater than or equal to 5.9 m/min, with maximum 102 mm slab thickness.

By using the disclosed casting parameters, on the one hand a high production quality is guaranteed, in that the liquidus tip of the slab, independent of the respective material quality-dependent maximum casting velocities, always reaches to the end of the slab-guiding device, on the other hand an extraordinarily high production capacity is achieved.

The steel strip, during its thickness reduction in the roughing train downstream from the slab-guiding device, has a sufficiently hot cross-sectional core to be rolled with relatively low energy expenditure.

The energy expended in rolling hot steel strip is thus significantly reduced and the efficiency of generic plants is increased.

The results of calculations have shown that, when the disclosed casting parameters are used for slabs of between 1400 and 1850 mm in width, production capacities of more than 3 million tons per year (mtpy) are possible which, compared to plants or methods in accordance with the prior art, means a large increase and makes a far more cost-effective production of hot steel strip possible, but without risking any detrimental effects on quality. By means of an disclosed method steel qualities are also able to be processed which, according to predominating expert opinion, have not been at all suitable for a continuous or endless production process.

In order to further optimize the disclosed method, specific method parameters have been determined by calculations and trial arrangements, which make possible significant progress in the production of hot steel strip in respect of production quality and energy efficiency.

There is provision herein for slabs with different slab thicknesses to be cast as a function of the following casting velocities:

- for casting velocities between 3.8 and 5.0 m/min, with 100-120 mm slab thickness, preferably with 110 to 120 mm slab thickness,
- for casting velocities between 5.0 and 5.9 m/min, with 85-110 mm slab thickness, preferably with 95 to 110 mm slab thickness,
- for casting velocities greater than or equal to 5.9 m/min, with maximum 102 mm slab thickness.

Such an adjustment of corresponding slab thicknesses as a function of respective (steel-specific) maximum casting velocities guarantees that the liquidus tip of the slab—with the exception of the casting phase—is always kept to some extent close to the end of the slab-guiding device and thereby the casting heat can be used optimally for increasing the efficiency of subsequent rolling processes.

In accordance with a further embodiment the slab may be rough rolled in the roughing train into an intermediate strip in at least four rolling passes, i.e. using four roughing stands, preferably in five rolling passes, i.e. using five roughing stands.

While in methods in accordance with the prior art the slab is mostly rough rolled in three rolling passes, a use of four or five rolling passes enables the energy efficiency of the rolling method to be further improved. By four or five rolling passes being carried out in the fastest possible sequence, the casting heat still present in the slab is utilized in the optimum way. Furthermore, when four or five rolling passes are performed, almost independently of the initial thickness of the cast slab, a very narrow range of thicknesses of the intermediate strip (between 3 and 15 mm, preferably between 4 and 10 mm) is obtained so that a heating device disposed downstream from the roughing train, e.g. an inductive cross-field heating oven, can be designed precisely for a specific range of thicknesses of the intermediate strip. Energy losses from dimensioning the consumption of the heating device too high can thus be avoided.

In accordance with a further embodiment the four or five rolling passes taking place in the roughing train are undertaken within at most 80 seconds preferably within at most 50 seconds.

In accordance with a further embodiment the first rolling pass in the wrapping train may be undertaken within at most 7 minutes, preferably within at most 6.2 minutes of the start of solidification of the liquid steel slab present in the casting plant. Ideally the first rolling pass in the roughing train occurs within at most 5.8 minutes, with this also being done at casting velocities in the range of 4 m/min.

In accordance with a further embodiment, between the end of the slab-guiding device and an entry area of the roughing train, only cooling resulting from the ambient conditions is provided, in the form of natural convection and radiation, to be allowed, i.e. for no artificial cooling of the slab to be undertaken by means of a cooling device.

In accordance with a further embodiment the thickness of the slab may be reduced by 35-60%, preferably by 40-55%. When exactly four rolling stands are provided, this results in an intermediate strip with a thickness of around 3 to 15 mm, preferably with a thickness of 4 to 10 mm, emerging from the roughing train.

In accordance with a further embodiment a temperature loss rate of the intermediate strip emerging from the roughing train may lie below a maximum of 3 K/m, preferably below a maximum of 2.5 K/m. A realization of temperature loss rates<2 K/m would also be conceivable. Such a temperature loss rate occurs through heat radiation and/or convection from the intermediate strip and is able to be controlled by an appropriate choice of general thermal conditions (covers, tunnels, cold air, air humidity, . . . ) and the transport speed or mass flow.

In accordance with a further embodiment heating of the intermediate strip emerging from the roughing train may be performed by an inductive heating device, e.g., in a cross-field heating method, beginning at a temperature of above 770° C., preferably above 820° C., to a temperature of at least 1110° C., preferably to a temperature above 1170° C.

In accordance with a further embodiment the intermediate strip may be heated within a period of time of 4 to 25 seconds, preferably within a period of time of 5 to 13 seconds.

In accordance with a further embodiment, when exactly four rolling passes are performed in the roughing train, the time elapsing between the first rolling pass and the entry into the heating device for intermediate strip thicknesses of 5-10 mm, does not amount to longer than 105 seconds, preferably to longer than 70 seconds.

Adherence to the these parameters produces a very compact plant in which the distance from the heating device to the casting plant or to the roughing train is kept very short which makes a thermal efficiency advantage possible.

In accordance with a further embodiment finishing rolling of the heated intermediate strip in the finish rolling train may be performed in four rolling passes, i.e. using four finishing rolling stands, or in five rolling passes, i.e. using five finishing rolling stands, to a final strip with a thickness<1.5 mm, preferably <1.2 mm. By means of the disclosed method rolling to final thicknesses of <1 mm is also possible.

In accordance with a further embodiment the rolling passes may be performed within the finishing rolling train by the five or four finishing rolling stands to be carried out within a period of time of a maximum of 16 seconds, preferably within a period of time of a maximum of 8 seconds.

In accordance with a further embodiment, for Liquid Core Reduction (LCR) thickness reduction of the slab, predetermined guide elements of the slab-guiding device are able to be (transversely) adjusted relative to a longitudinal axis of the slab for making contact with it, wherein an adjustment of the guide elements is undertaken as a function of the material of the slab and/or of the casting velocity, in order to reduce the slab thickness by up to 30 mm.

In accordance with a further embodiment the slab thickness may be adjusted once quasi-statically, i.e. shortly after the start of casting or the beginning of a casting sequence as soon as the hot front slab end area, referred to as the "slab head" has passed the guide elements provided for thickness reduction.

In a further embodiment the slab thickness may adjustable dynamically, i.e., variable to any given extent during the casting process or during its passage through the slab-guiding device. The dynamic setting may then be made by the operating team as a function of the steel quality and the current casting velocity, provided this only changes in some cases. The LCR thickness reduction amounts to between 0 and 30 mm, preferably between 3 and 20 mm.

In one embodiment of the dynamic use of LCR this function can also be taken over by an automated device, especially when frequent thickness or velocity changes would be normal or required.

The combination of the setting of the slab thickness combined with the casting velocity is undertaken by means of proposed speed factors K, which are chosen as a function of the slab support length and quality of the slab steel.

Corridor ranges are specified in each case for the speed factor K, within which casting operation can be carried out efficiently and viably.

The cooling characteristics of respective steel qualities has a great influence on the position of the liquidus tip within the slab. Rapidly solidifying steel qualities allow the plant to be operated with relatively high casting velocities v while lower casting velocities $v_c$ are to be selected for more slowly solidifying steel qualities, in order to prevent a bulging and bursting of the slab in the area of the liquidus tip. The terms "hard cooling" (rapid solidifying), "medium-hard cooling" and "soft cooling" (rather slow solidification) are used in connection with the speed of the cooling of the slab.

To cool the slab, a coolant, preferably water, is applied to it in the area of the slab-guiding device (between the end of the die and the end of the slab-guiding device facing towards the roughing train). The coolant is applied to the slab by means of a spray device which can comprise any given number of spray nozzles.

For hard cooling, 3 to 4 liters of coolant are used per kg of slab steel, while for medium-hard cooling 2 to 3.5 liters of coolant are used per kg of slab steel and for soft cooling<2.2 liters of coolant are used per kg of slab steel. The quantities of coolant given for hard, medium-hard and soft cooling overlap, since the realization of hard, medium-hard or soft cooling depends not only on the amount of coolant but also on the mechanical design of the spray device, especially the construction of the nozzles (pure water nozzles and air/water nozzles, so-called 2-phase nozzles exist). Further influencing factors for the speed of the slab cooling are the construction of the guide elements or slab support rollers of the slab-guiding device (internally or externally cooled slab support rollers), the arrangement of the support rollers, especially the ratio of the support diameter to the distance between adjacent support rollers, the spray character of the nozzles and also the coolant or water temperature respectively.

Within the proposed corridor ranges an actual speed factor K is especially chosen as a function of the steel quality or the cooling characteristic of the slab. For steel qualities to be cooled down rapidly a speed factor K lying in the upper range of a proposed corridor range can be included, while for steel qualities to be cooled more slowly a speed factor K lying in the lower range of a proposed corridor range can be included.

Thus, in accordance with a technical optimization method, there is provision that for slab steel to be hard cooled by means of a spray device in the area of the slab-guiding device, i.e. by applying 3 to 4 liters of coolant per kg of slab steel, in a stationary continuous mode of the plant, the relationship of a slab thickness d measured in [mm] with the casting velocity $v_c$ measured in [m/min] is adhered to in accordance with the formula $v_c=K/d^2$, wherein a speed factor K contained in the formula for a slab support L=17.5 m, lies in a corridor range of 42000 to 48900, preferably in a corridor range of 45500 to 48900, while the speed factor K for a slab support length L=23 m, lies in a corridor range of 55200 to 64600, preferably in a corridor range of 59900 to 64600, wherein for determination of (target) casting velocities $v_c$ or (target) slab thicknesses d for plants with slab support lengths L lying between the slab support lengths L=17.5 m and L=23 m, an interpolation between the previously listed corridor ranges is able to be carried out.

A stationary-continuous operation of the plant is to be understood in the present context as operating phases with a duration>10 minutes, during which the casting velocity is essentially constant. The definition of the stationary-continuous plant operation serves on the one hand merely to distinguish it from an operating phase during which the liquid steel initially passes through the slab-guiding device and during which the casting velocity is subject to extraordinary parameters, or on the other hand to distinguish it from acceleration phases also possible in the interim for increasing the throughput and/or operationally-required delay phases (when the plant needs to wait for liquid steel to be delivered or on account of the slab quality, lack of cooling water, . . . ).

For slab steels to be cooled to medium hardness, i.e. by applying 2 to 3.5 liters of coolant per kg of slab steel, in a stationary-continuous operation of the plant, the relationship between a slab thickness d measured in [mm] and the casting velocity $v_c$ measured in [m/min] is adhered to in accordance with the formula $v_c=K/d^2$, wherein a speed factor K contained in the formula for a slab support length L of 17.5 m lies in a corridor range of 39600 to 46500, preferably in a corridor range of 43050 to 46500, while the speed factor K for a slab support length L=23 m lies in a corridor range of 52100 to 61900, preferably in a corridor range of 57000 to 61900, wherein for determining (target) casting velocity velocities $v_c$ or (target) slab thicknesses d for plants with slab support lengths L lying between the slab support lengths L=17.5 m and L=23 m, an interpolation between the previously listed corridor ranges is able to be carried out.

For slab steels to be cooled to soft hardness, i.e. by applying less than 2.2 liters (preferably between 1.0 and 2.2 liters) of coolant per kg of slab steel, in a stationary-continuous operation of the plant, the relationship between a slab thickness d measured in [mm] and the casting velocity $v_c$ measured in [m/min] is adhered to in accordance with the formula $v_c=K/d^2$, wherein a speed factor K contained in the formula for a slab support length L of 17.5 m lies in a corridor range of 37100 to 44100, preferably in a corridor range of 40600 to 44100, while the speed factor K for a slab support length L=23 m lies in a corridor range of 48900 to 59000, preferably in a corridor range of 53950 to 59000, wherein for determining (target) casting velocities $v_c$ or (target) slab thicknesses d for plants with slab support lengths L lying between the slab support lengths L=17.5 m and L=23 m, an interpolation between the previously listed corridor ranges is able to be carried out.

The detailed/refined choice of the speed factor, as well as being dependent on the slab support length, is especially dependent on the carbon content of the cast steels, their solidification or transformation characteristics, their solidity or ductility properties etc.

Operational management in accordance with the proposed speed factors K makes it possible to use the casting heat contained in the slab in the optimum way for the subsequent rolling process and also to optimize the material throughput and thus a productivity advantage (with an operational reduction of the casting velocity the slab thickness can be increased and thus the material throughput increased).

Claim 19 relates to a plant for carrying out the disclosed method for continuous or semi-continuous production of hot steel strip, comprising a casting plant with a die, a slab-guiding device disposed downstream thereof, a roughing train disposed downstream thereof, and induction heating device disposed downstream thereof and a finish rolling train disposed downstream thereof, wherein the slab-guiding device has a lower series of guide element and an upper series of guide elements disposed in parallel or converging therewith and a receiving shaft intended for receiving the slab emerging from the casting plant is embodied between the two series of guide elements which, by forming different distances between opposite guide elements in the transport direction of the slab is at least narrowed in sections and thereby the slab is able to be reduced in thickness. There is provision for the clear receiving width of the receiving shaft, at its input area pointing towards the die, to amount to between 105 and 130 mm, preferably to between 115 and 125 mm, for the receiving shaft, at its end pointing towards the roughing train to have a clear receiving width corresponding to the thickness of the slab of between 85 and 120 mm, preferably between 95 and 115 mm, wherein a slab support length measured between the bath surface of the casting plant and the end of the receiving shaft of the slab-guiding device facing towards the roughing train, amounts to greater than or equal to 18.5 m, preferably in a range between 18.7 and 23 m, especially preferably lies between 20.1 and 23 m, and wherein a control device is provided, by means of which the casting velocity $v_c$ of the slab 3 is able to be held in a range between 3.8-7 m/min.

In accordance with a further preferred variant of the disclosed plant there is provision for the roughing train to have four or five roughing stands.

In accordance with a further preferred variant of the disclosed plant there is provision, between the end of the receiving shaft or the slab-guiding device and an input area of the roughing train, for there not to be any cooling device but for a thermal cover to be provided which surrounds at least sections of a conveyor device intended for transport of the slab and thus delays cooling down of the slab.

In accordance with a further preferred variant of the disclosed plant there is provision, by means of roughing stands disposed in the roughing train, for a reduction of the thickness of the slab by respectively 35-60%, preferably by respectively 40-55% to be able to be carried out so that an intermediate strip with a thickness of 3 to 15 mm, preferably with a thickness of 4 to 10 mm, is able to be created. In accordance with a further preferred variant of the disclosed plant there is provision for the heating device to be embodied as an inductive cross-field heating oven, by means of which the slab, beginning at a temperature of above 770° C., preferably of above 820° C., is able to be heated up to a temperature of at least 1110° C., preferably to a temperature of above 1170° C.

In accordance with a further preferred variant of the disclosed plant there is provision for the finish rolling train to comprise four or five finish rolling stands, by means of which an intermediate strip emerging from the roughing train is able to be reduced to a final strip with a thickness<1.5 mm, preferably in <1.2 mm.

In accordance with a further preferred variant of the disclosed plant there is provision for the finish rolling stands to each be disposed at a distance of <7 m, preferably at a distance of <5 m from one another, wherein the distance is measured between the working rolling axes of the finishing rolling stands.

In accordance with a further preferred variant of the disclosed plant there is provision for specific guide elements to be able to be (gap) adjusted for reducing the thickness of the slab and through this for a clear receiving width of the receiving shaft to be able to be reduced or enlarged, wherein the slab thickness or the clear receiving width is able to be adjusted as a function of the material of the slab and/or of the casting velocity.

In accordance with a further preferred variant of the disclosed plant there is provision for the adjustable guide elements to be disposed in a front half facing towards the die, preferably in a front quarter facing towards the die of the longitudinal extent of the slab guiding device.

In order, at least during the first two rolling passes, to guarantee the presence of a slab core of the slab that is as hot as possible, in accordance with a preferred variant of the disclosed plant there is provision for a working roller axis of a first roughing stand of the roughing train closest to the slab-guiding device to be disposed at a maximum of 7 m, preferably at a maximum of 5 m after the end of the slab-guiding device.

In accordance with a further embodiment an entry end of the heating device facing towards the roughing train may be disposed at a maximum of 25 m, preferably at a maximum of 19 m after the working roller axis of the roughing stand closest to the heating device.

FIG. 1 shows a schematic of a plant 1, by means of which a method for continuous or semi-continuous production of hot steel strip is able to be carried out.

The figure shows a vertical casting plant with a die 2 in which the slabs 3 are cast, which have a slab thickness d of between 105 and 130 mm, preferably a slab thickness d of between 115 and 125 mm at the end of the die 2.

Located in front of the die 2 is a pan 35, which loads a distributor 36 with liquid steel via a ceramic feed nozzle. The distributor 36 subsequently loads the die 2 to which a slab-guiding device 6 is connected.

The roughing then takes place in a roughing train 4 which can include one—as here—or of a number of rolling stands and in which the slab 3 is rolled to an intermediate thickness. In roughing cast materials are converted into fine-grain rolled materials.

The plant 1 also includes a series of components not shown in FIG. 1, such as descaling devices 37, 38 and separation devices not shown in FIG. 1, which essentially corresponds to the prior art and which will thus not be described in greater detail at this point. The separation devices, embodied for example in the form of fast-cut shears, can be disposed at any given position of the plant 1, especially between the roughing train 4 and the finish rolling train 5 and/or in an area downstream from the finish rolling train 5.

Disposed beyond the roughing train 4 is a heating device 7 for the intermediate strip 3'. The heating device 7 is embodied in the present example embodiment as an induction oven. Preferably a cross-field heating induction oven is used, which makes the plant 1 especially energy-efficient.

As an alternative the heating device 7 could also be embodied as a conventional oven, e.g. with application of flames.

In the heating device 7 the intermediate strip 3' is brought relatively evenly over its cross section to a desired feed temperature for feeding into the finish rolling train 5, wherein the feeding temperature as a rule, depending on the type of steel and subsequent rolling process in the finish rolling train, lies between 1000° C. and 1200° C.

After being heated up in the heating device 7—after an intermediate optional descaling—the finish rolling is undertaken in the multi-stand finish rolling train 5 to a desired final thickness and final rolling temperature and subsequently the strip is cooled in a cooling section 18 and is finally wound into coils by means of underfloor coilers 19.

Figure 2:
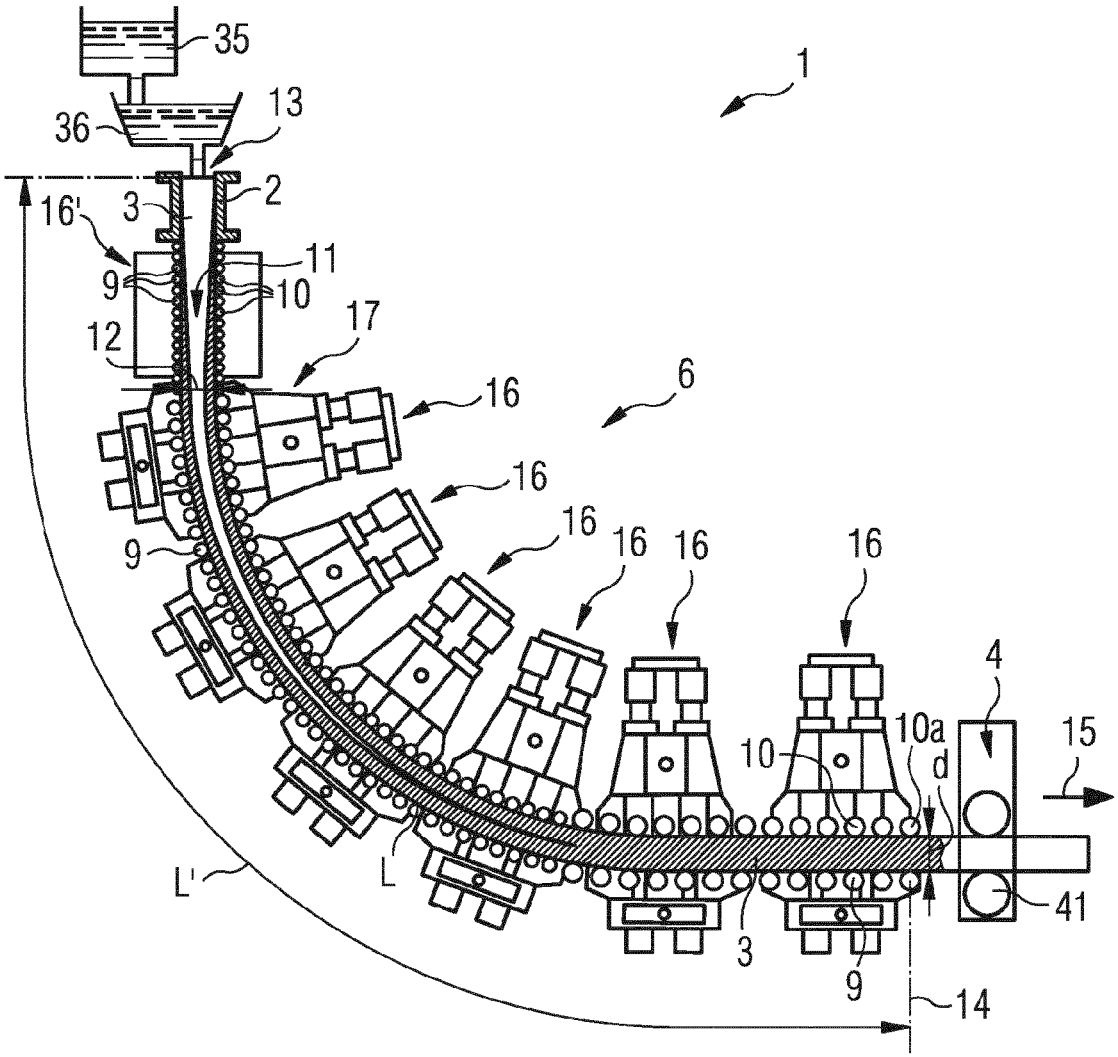
FIG. 2 shows a detailed diagram of a slab-guiding device of the plant from FIG. 1 in a vertical cross-sectional view.
Figure 3:
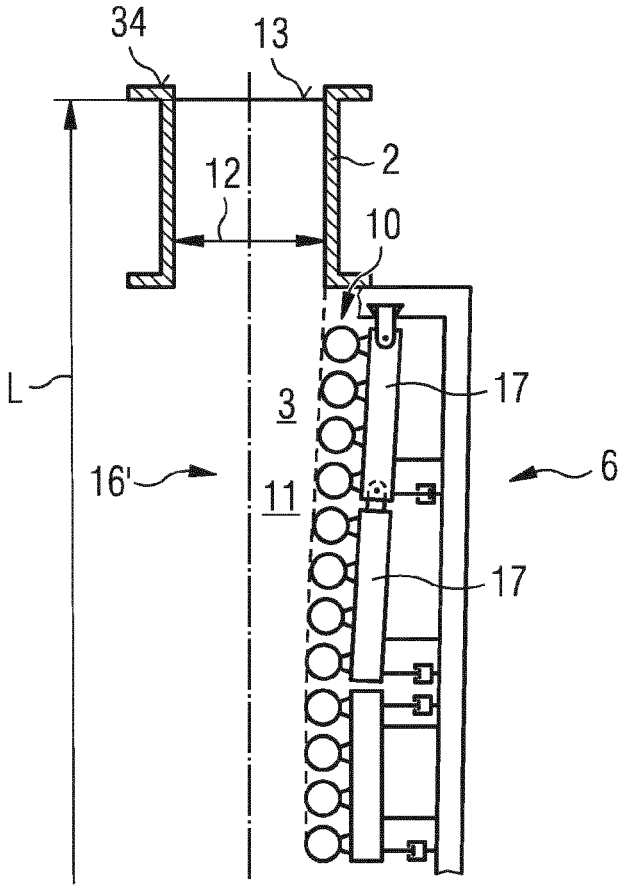
FIG. 3 shows a section of the slab-guiding device in a cross-sectional detailed view.

The following method steps may be carried out:

Initially a slab 3 is cast with a casting plant 2 (one die of the casting plant is shown in FIGS. 1-3). The slab 3 is reduced in the Liquid Core Reduction (LCR) method by means of the slab-guiding device 6 with a liquid cross-sectional core to a slab thickness d of between 85 and 120 mm, preferably to a slab thickness of between 95 and 115 mm.

A slab support length L measured between the meniscus 13, that is the bath level of the casting plant 2 and an end 14 of the slab guiding device 6 facing towards the roughing train 4 is greater than or equal to 18.5 m, preferably the slab support length L lies in a range between 18.7 (even better 20.1) and 23 m. A casting velocity $v_c$ of the slab 3 measured during stationery-continuous operation of the plant lies here in a range of 3.8-7 m/min.

The meniscus 13 shown in detail in FIG. 3 is generally located a few centimeters below the upper edge 34 of the die 2 which is usually made of copper.

The slab support length L is measured here between the meniscus 13 of the die or of the casting plant 2 and the axis of the last roller of an upper guide element series 10 described in greater detail below (viewed in a side view of the plant 1 in a direction parallel to the axes of the rollers in accordance with FIG. 1). For exact measurement the slab support length L is measured at an outer width side of the slab 3 or of the slab-guiding device 6 opposite the center point of the radius of curvature of the slab 3 or of the slab-guiding device 6 (as well as a section of the inside of the die 2). So that the outer width side of the slab 3 or of the slab support length L touched by support rollers 10 can be better recognized an auxiliary dimensioning line L' concentric to the slab support line L is marked in FIG. 2.

In order to guarantee that a liquidus tip of the slab 3 defined at the outset always extends, independently of the respective material-quality dependent maximum casting velocities, to close to the end of the slab-guiding device 6 and thereby that the slab 3 can also be rolled to a finished product beforehand and afterwards with a relatively low energy outlay and while guaranteeing high production quality, slabs 3 are cast with different slab thicknesses d as a function of the following casting velocities:

- at casting velocities of between 3.8 and 5.0 m/min, with 100-120 mm slab thickness, preferably with 110 to 120 mm slab thickness,
- at casting velocities of between 5.0 and 5.9 m/min, with 85-110 mm slab thickness, preferably with 95 to 110 mm slab thickness,
- at casting velocities of greater than or equal to 5.9 m/min, with maximum 102 mm slab thickness.

The slab 3 is rough rolled in the roughing train 4 to an intermediate strip 3' in at least four rolling passes, i.e. using four roughing stands $\mathbf{4}_1$, $\mathbf{4}_2$, $\mathbf{4}_3$, $\mathbf{4}_4$, preferably in five rolling passes, i.e. using five roughing stands $\mathbf{4}_1$, $\mathbf{4}_2$, $\mathbf{4}_3$, $\mathbf{4}_4$, $\mathbf{4}_5$.

The four or five rolling passes performed in the roughing train 4 occur within at most 80 seconds, preferably within at most 50 seconds.

Furthermore there is provision for the first rolling pass in the roughing train 4 to take place within at most 7 minutes, preferably within at most 6.2 minutes of the start of solidification of the liquid slab steel present in the casting plant 2. Ideally the first rolling pass in the roughing train 4 takes place within at most 5.8 minutes, this also occurring with casting velocities in the range of 4 m/min.

Between the end 14 of the slab-guiding device 6 and an entry area of the roughing train 4, the slab 3 is only allowed to be cooled as a result of an ambient temperature, i.e. there is no artificial cooling of the slab 3 by means of a cooling device. The surface of the slab 3 has an average temperature in this area of >1050° C., preferably >1000° C.

A preferably foldable thermal cover is provided between the end 14 of the slab-guiding device 6 and the first roughing stand $\mathbf{4}_1$, to retain the heat in the slab 3 as much as possible. The thermal cover surrounds a conveyor device provided for transport of the slab 3, usually embodied at least in sections as a roller conveyor. Immediately in front of the underfloor coilers 19 the final strip 3" is clamped between drive rollers 38, which also guide the final strip 3" and keep it under tension.

In this case the thermal cover can surround the conveyor device from above and/or from below and/or to the sides.

The thickness of the slab 3 is reduced in the roughing train 4 in each rolling pass by 35-60%, preferably by 40-55%. If precisely four rolling passes are provided, the result is thus that an intermediate strip 3' with a thickness of 3 to 15 mm, preferably emerges from the roughing train 4 with a thickness of 4 to 10 mm.

In order to guarantee, at least during the first two rolling passes, the presence of a slab core of the slab 3 which is as hot as possible, the first roughing stand $\mathbf{4}_1$ of the roughing train 4 closest to the slab-guiding device 6 is disposed a maximum of 6 m, preferably a maximum of 5 m, ideally a maximum of 4 m, after the end 14 of the slab-guiding device 6. The said distances are measured here in each case from the center point of the first roughing stand $\mathbf{4}_1$ or from its working roller axis respectively.

In accordance with a further preferred process technology variant there is provision for the cooling of the intermediate strip 3' emerging from the roughing train 4 at a cooling rate of a maximum of 3 K/m, preferably at cooling rate the maximum of 2.5 K/m. Such a cooling rate occurs through heat radiation and/or convection from the intermediate strip and is able to be controlled by an appropriate choice of the general thermal conditions (covers, tunnels, cold air, air humidity, etc.) and transport speed or mass flow respectively.

In one embodiment a heating of the intermediate strip 3' emerging from the roughing train 4 may be performed by an inductive heating device 7, e.g., in a cross-field heating method, beginning at a temperature of above 770° C., preferably of above 820° C., especially preferably: above 950° C., to a temperature of at least 1110° C., preferably to a temperature of above 1170° C.

The intermediate strip 3' is heated up within a period of 4 to 25 seconds, preferably within a period of 5 to 13 seconds.

When precisely 4 rolling passes are performed in the roughing train 4 there is provision for a 100 mm thick slab 3, which on exit from the casting plant 2 or on entry into the slab-guiding device 6, is reduced in the roughing train 4 to an intermediate strip 3' with a thickness of 7 mm, after 360 seconds at the latest, preferably after 340 seconds at the latest after its exit from the casting plant 2, to be fed into the inductive heating device 7 and for a 115 mm thick slab 3, on exit from the casting plant 2 or on entry into the slab-guiding device 6, which is reduced in the roughing train 4 to an intermediate strip 3' with a thickness of 7.8 mm, after 480 seconds at the latest, preferably after 460 seconds at the latest after its exit from the casting plant 2, to be fed into the inductive heating device 7.

The heated intermediate strip 3' is preferably finished in the finish rolling train 5 in four rolling passes, i.e. using four finishing stands $\mathbf{5}_1$, $\mathbf{5}_2$, $\mathbf{5}_3$, $\mathbf{5}_4$ or in five rolling passes, i.e. using five finishing stands $\mathbf{5}_1$, $\mathbf{5}_2$, $\mathbf{5}_3$, $\mathbf{5}_4$, $\mathbf{5}_5$ to a final strip 3" with a thickness of <1.5 mm, preferably of <1.2 mm. Rolling to end thickness of <1 mm is also possible with the disclosed method.

The finishing stands $\mathbf{5}_1$, $\mathbf{5}_2$, $\mathbf{5}_3$, $\mathbf{5}_4$, $\mathbf{5}_5$ are respectively disposed at a distance of <7 m, preferably at a distance of <5 m from each other (measured between the working rolling axes of the finishing stands $\mathbf{5}_1$, $\mathbf{5}_2$, $\mathbf{5}_3$, $\mathbf{5}_4$, $\mathbf{5}_5$).

Subsequently the final strip 3" is cooled to a coiling temperature between 500° C. and 750° C., preferably to between 550° C. and 650° C. and is wound into a coil. Finally the final strip 3' or the intermediate strip 3' or the strip 3 is separated in a direction running transverse to its transport direction 15 and final coiling of the final strip 3' loose on the rolling train side is undertaken. As an alternative to coiling a redirection and stacking of the final strip 3" would also be possible.

As can be seen in FIG. 2, the slab-guiding device 6 has a number of guide segments 16 in accordance with FIG. 3 intended for the passage of the slab 3, which are constituted in each case by a lower series of guide elements 9 and an upper series of guide elements 10 arranged in parallel or converging therewith (not shown in FIG. 3).

Assigned to each guide element of the lower guide element series 9 is an opposing guide element of the upper guide element series 10. The guide elements are thus disposed in pairs on both sides of the width sides of the slab 3.

Embodied between the two guide element series 9, 10 is a receiving shaft 11 designed to receive a slab 3 emerging from the casting plant 2, which by embodying different distances between opposing guide elements 9, 10 from one another in the transport direction of the slab 3, is narrowed at least in sections and thereby the thickness of the slab is able to be reduced. The guide elements 9, 10 are embodied as rotatably supported rollers.

As can be seen in FIG. 2, the upper and lower guide elements or roller series 9, 10 can each be subdivided in their turn into (sub) series of specific rollers with different diameters and/or shaft spacings.

The guide elements of the upper guide element series 10 are selectively depth-adjustable or can be moved closer to the guide elements of the lower guide element series 9. An adjustment of the guide elements of the upper guide element series 10 and thus a change in the clear receiving cross section 12 of the slab-guiding device 6 can be undertaken for example by means of a hydraulic drive. A clear receiving width 12 of the receiving shaft 11 of the slab-guiding device 6 corresponding to the desired slab thickness d and measured between upper and lower guide elements lying opposite one another could be reduced for example from 115 mm to a range between 90 and 105 mm.

Since a slab 3 guided into a narrower receiving shaft 11 solidifies and cools off more rapidly, the casting velocity and also equivalent thereto the volume flow passing through the rolling trains 4, 5 would have to be increased if one still wished to guide the liquidus tip of the slab as close as possible to the end of the slab-guiding device 6.

To reduce the thickness of the slab 3, three to eight guide element (pairs) of a first guide segment 16' facing towards the die 2—but not necessarily adjacent to the die 2—are adjustable. As an alternative a number of guide segments 16 arranged next to one another, which adjoin the die directly or indirectly can be employed for LCR thickness reduction.

The slab thickness d or the clear receiving width 12 is able to be adjusted as a function of the material of the slab 3 and/or as a function of the casting velocity.

The respective guide elements 9, 10 are adjusted in a direction running essentially orthogonally to the transport direction of the slab, wherein both the upper guide elements 10 and also the lower guide elements 9 can be adjustable. As can be seen in FIG. 3, upper guide elements 10 are articulated on corresponding support elements 17, which are preferably hydraulically adjustable.

The adjustable guide elements 9, 10 are preferably disposed in a front half facing towards the casting plant 2, preferably in a front quarter facing towards the casting plant 2 of the longitudinal extent of the slab-guiding device 6.

The slab thickness d or the clear receiving width 12 can be set quasi-statically, i.e. once shortly after the beginning of casting as soon as a head area of the cast slab 3 facing towards the roughing train 4 has reached the end of the slab-guiding device 6 or has passed the LCR guide elements, or also dynamically, i.e. during the casting process or during the continuous quasi-stationary passage of the slab 3 through the slab-guiding device 6. When the slab thickness d is set dynamically this is changed during the passage of a slab 3 through the slab-guiding device 6 any given number of times using the situation explained below with reference to FIG. 6 as the guideline.

Figure 4:
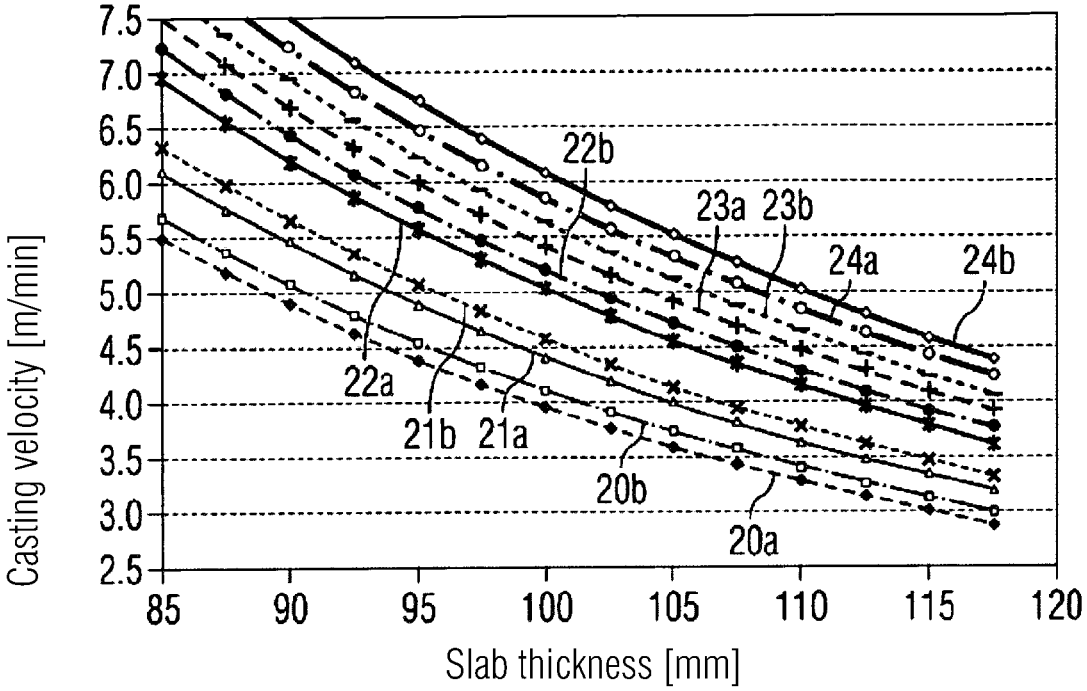
FIG. 4 shows a process diagram of a production method (casting velocity/slab thickness), according to an example embodiment.

FIG. 4 shows a process diagram for illustrating the disclosed manufacturing method. With reference to this diagram it is evident why desired high production capacities with generic systems for manufacturing hot steel strip are only able to be achieved while adhering to the proposed casting parameters, namely with comparatively large slab thicknesses compared to known methods and large metallurgical or slab support lengths L.

Plotted on the ordinate of the diagram in accordance with FIG. 4 is the casting velocity in the unit [m/min], while the slab thickness is plotted on the abscissa in the unit [mm]. Approximately parabola shaped lines 20*a*, 20*b*, 21*a*, 21*b*, 22*a*, 22*b*, 23*a*, 23*b*, 24*a* and 24*b* are plotted, which each correspond to a casting characteristic at a specific metallurgical or slab support length L.

A number of lines are shown here for selected slab support lengths L, since different steel qualities are able to be cooled at different speeds and possess different solidifying speeds.

The lines 20*a* and 20*b* correspond to a slab support length L of 15.2 m, wherein line 20*a* is based on a different material-specific (global) solidification factor k from line 20*b* and these two related lines therefore differ from one another.

The solidification factor k is expressed in the unit [mm/√min] and lies for materially relevant steel quality between 24-27 mm/√min, preferably between 25 and 26 mm/√min.

The lines 21*a* and 21*b* correspond to a slab support length L of 17.5 m, wherein the lines 21*a* and 21*b*, like the lines 20*a* and 20*b*, are again based on a different solidification factor k.

The lines 22*a* and 22*b* correspond to an example slab support length L of 18.5 m and again merely differ in respect of a specific solidification factor k.

The lines 23*a* and 23*b* correspond to an example slab support length L of 20 m and again differ in respect of a specific solidification factor k.

The lines 24*a* and 24*b* correspond to an example slab support length L of 21.6 m and likewise differ in respect of a specific solidification factor k.

Because of the problem of the liquidus tip position of the slab 3 already discussed, it goes without saying that in a casting process a casting velocity is to be selected which is all the smaller, the shorter the slab support length L of a respective plant is (a liquidus tip in the transport direction 15 stretching beyond the end 14 of the slab-guiding device 6 would lead to a cracking of the slab 3).

Conversely it can be read from the diagram in accordance with FIG. 4 which required slab thickness has to be selected for an optimized casting process if the object is to cast at a desired casting velocity.

If in the diagram in accordance with FIG. 4 for example, the line 24 *b* (L=21.6 m) is intersected by means of a vertical line at a slab length of 110 mm and the observer looks from the intersection point obtained to the left on the ordinate, an allowable casting velocity of just above 5 m/min is obtained.

The casting characteristics in accordance with FIG. 4 are selected purely by way of example and are not to be understood as being restrictive. Basically no fixed velocity value is produced for each slab thickness but always a corresponding range of velocities (and vice versa), below which the casting process would be reliably managed (designated "inventional area" in FIG. 4). Likewise the slab support length L is not to be reduced to a specific value, such as 18 m for example, but it has been proven that slab support lengths L, which are greater than 17.5 m (and preferably smaller than 23 m), already make a significant capacity increase possible compared to known plants.

For example, for a slab support length L of around 22 m (verify in the example embodiment in accordance with FIG. 4 on the basis of 24*a*, 24*b*, which however each correspond to an exact slab support length L of 21.6) a viable casting velocity range of 4.2-6.5 m/min is produced, when a slab thickness of 96-117.5 mm is cast.

The result of calculations has been that for example, for a slab support length L of 22 m (which essentially corresponds to lines 24*a* and 24*b*), a generic plant 1 for producing hot strip steel can reach a production capacity of around 3.8 million tons per year (mtpy) which, compared to plants in accordance with the prior art, means a large increase.

Figure 5:
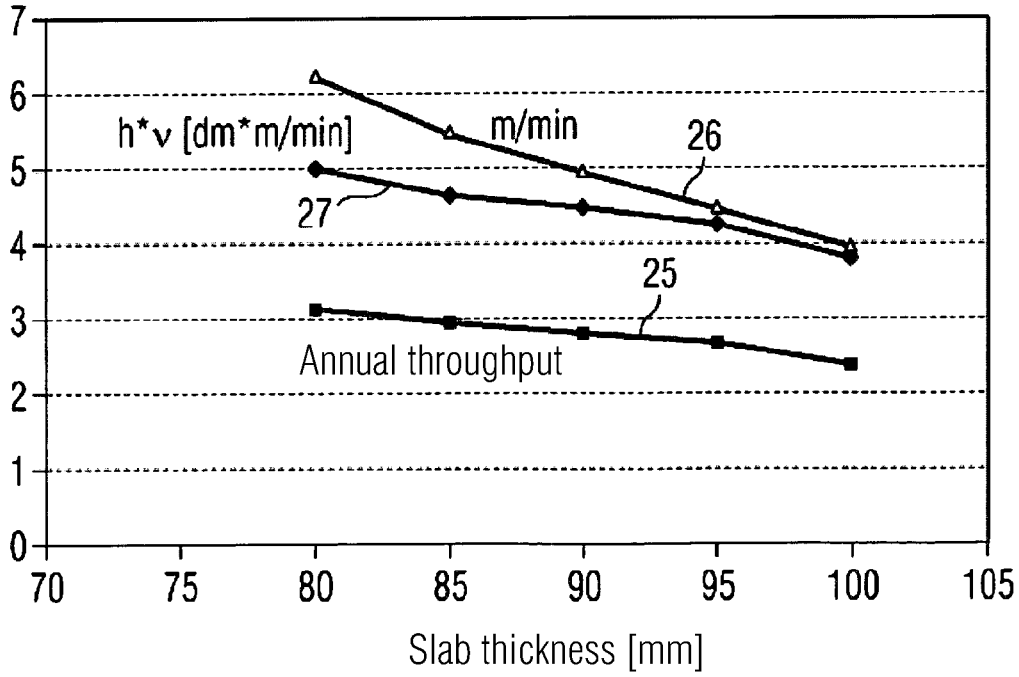
FIG. 5 shows a diagram to illustrate the annual throughput of a plant as a function of the slab thickness (casting velocity/slab thickness), according to an example embodiment.

FIG. 5 shows a diagram to illustrate the annual throughput (line 25), the casting velocity (line 26) and the width-specific volume flow (line 27) as a function of the slab thickness plotted on the abscissa (for a slab width of 1880 mm).

Figure 6:
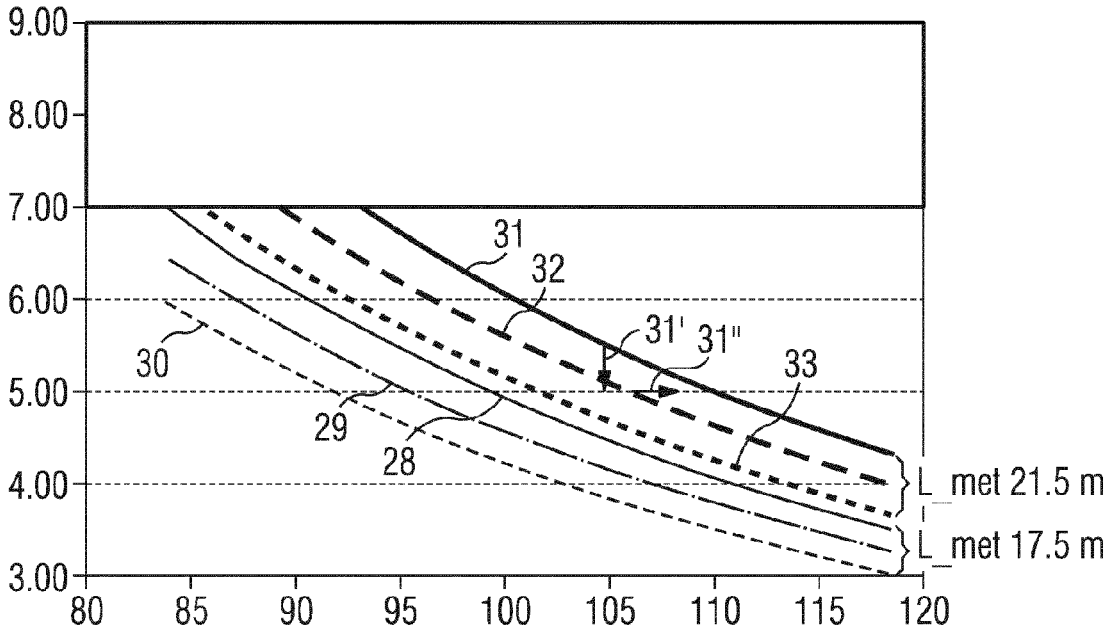
FIG. 6 shows a process diagram of a production method (relationship between target casting velocity and target slab thicknesses), according to an example embodiment.

FIG. 6 illustrates the relationship between the slab thickness d and the casting velocity v wherein a setting of (target) casting velocity $v_c$ or (target) slab thicknesses d is able to be determined on the basis of proposed speed factors K. The relationship of the setting of the slab thickness d in conjunction with the casting velocity $v_c$ is established in accordance with the formula stored in a device: $v_c$=[K_lowerLimit . . . K_upperLimit]/$d^2$.

The following specifications relate to a stationary-continuous operation of the plant, by which in the present context operating phases with the duration of >10 minutes are understood, during which the casting velocity $v_c$ (unlike in an initial casting phase for example) remains essentially constant.

As well as being dependent on the support length L, the selection of the speed factor K is dependent, especially on the C content of the cast steels or on their cooling characteristics respectively. Rapidly solidifying steel qualities allow the plant to be operated at relatively high casing velocities v while for more slowly solidifying steel qualities, lower casting velocities $v_c$ are to be chosen in order to prevent bulging and cracking in the area of the liquidus tip. The following tables relate to steel qualities cast into slabs, which are "hard" to cool, i.e. solidify quickly and which are "medium-hard" to cool, i.e. solidify somewhat more slowly.

Corridor ranges are specified in each case for the speed factor K, within which casting operation is able to be carried out efficiently and viably. A slab support length-specific corridor range is limited in accordance with the following tables in each case by a speed factor K_upperLimit and a speed factor K_lowerLimit.

The choice of the speed factor K is dependent on the slab support length L and on the steel quality, especially on the carbon content of the cast steels, their solidification and conversion characteristics, their solidity or ductility properties and further material characteristics.

To cool the slab 3, a coolant, preferably water, is applied to this in the area of the slab-guiding device 6 (between the lower end of the die 2 and the end 14 of the slab-guiding device 6 facing towards the roughing train 4). The coolant is applied to the slab 3 by means of the spray device not shown in the figure comprising any given number of spray nozzles disposed in any given configurations (e.g. behind and/or next to and/or between the guide elements 9, 10).

For a hard cooling 3 to 4 liters of coolant per kg of slab steel are used, for a medium-hard cooling 2 to 3.5 liters of coolant per kg of slab steel and for a soft cooling<2.5 liters (preferably 1-2.2 liters) of coolant per kg. The quantities of coolant stated for a hard, medium hard and soft cooling overlap as a result of mechanical design features already listed above of the spray device and of the slab-guiding device 6.

Under exemplarily selected, essentially identical construction and general conditions of the spray device and of the slab-guiding device 6, 3 to 4 liters of coolant could be applied to realize hard cooling, 2 to 3 liters to realize medium-hard cooling and 1 to 2 liters to realize soft cooling per kg of slab steel.

TABLE 1

Speed factor K for steel qualities with low C content (<0.16%) and relatively hard cooling (3-4 l coolant/kg Slab steel):

| | L = 17.5 m | L = 21.5 m | L = 23 m |
|---|---|---|---|
| K_upperLimit | 48900 | 60300 | 64600 |
| K_lowerLimit | 42000 | 51600 | 55200 |

TABLE 2

Speed factor K for steel qualities with C content >0.16% and medium-hard cooling (2-3.5 l coolant/kg slab steel):

| | L = 17.5 m | L = 21.5 m | L = 23 m |
|---|---|---|---|
| K_upperLimit | 46500 | 57200 | 61900 |
| K_lowerLimit | 39600 | 48300 | 52100 |

TABLE 3

Speed factor K for specific steel qualities and soft cooling (1.0-2.2 l coolant/kg slab steel):

| | L = 17.5 m | L = 21.5 m | L = 23 m |
|---|---|---|---|
| K_upperLimit | 44100 | 54050 | 59000 |
| K_lowerLimit | 37100 | 44800 | 48900 |

There is thus provision in accordance with preferred operational management in accordance with Table 1 that for hard-to-cool slab steels, i.e. with application of 3 to 4 liters of coolant per kg of slab steel, the relationship between the slab thickness d measured in [mm] and the casting velocity $v_c$ measured in [m/min] is adhered to in accordance with the formula $v_c=K/d^2$, wherein a speed factor K contained in the formula lies for a preferably minimal slab support length $L_{min}$ of 17.5 m in a corridor range of 42000 to 48900, preferably a corridor range of 45500 to 48900, while the speed factor K for a preferably maximum slab support length $L_{max}$ of 23 m lies in a corridor range of 55200 to 64600, preferably in a corridor range of 59900 to 64600.

To determine (target) casting velocities $v_c$ or (target) slab thicknesses d for plants with slab support lengths L lying between the preferred slab support lengths $L_{min}$ and $L_{max}$, an interpolation between the previously listed corridor ranges (while adhering to a further corridor range not listed in the tables) is able to be carried out. Thus, for a slab support length L of 21.5 m for steel qualities with C content<0.16% and relatively hard cooling, produces a corridor range of 51600 to 60300. An interpolation between the corridor ranges occurs in an essentially linear manner.

In the case of slab support lengths>$L_{max}$, an extrapolation is also possible to the corridor ranges listed here.

In accordance with Table 2, for steel qualities with a C content>0.16% and medium-hard cooling, the inclusion of a speed factor K for a slab support length L of 17.5 m from a corridor range of 39600 to 46500 and for a slab support length L of 21.5 m from a corridor range of 48300 to 57200 and for a slab support length L of 23 m from a corridor range of 52100 to 61900 is recommended.

In accordance with Table 3, for steel qualities to be cooled softly, i.e. by application of 1 to 2.5 liters of coolant per kg of slab steel, the inclusion of a speed factor K for a slab support length L of 17.5 m from a corridor range of 37100 to 44100 and for a slab support length L of 21.5 m from a corridor range of 44800 to 54050 and for a slab support length L of 23 m from a corridor range of 48900 to 59000 is recommended.

FIG. 6 shows a diagram with characteristic curves 28-33 corresponding to the speed factors K given above. Plotted on the abscissa of the diagram in the unit [mm] is the slab thickness d (measured at the end of the slab-guiding device 6 or on entry into the roughing train 4), plotted on the ordinate is the casting velocity in the unit [m/min].

The characteristic curves 28, 29 and 30 apply for slab support lengths L=17.5 m, the characteristic curves 31, 32 and 33 for slab support lengths L=21.5 m.

Decisive in each case for an efficient operational management of the plant are the uppermost characteristic curves applying for a specific slab support lengths L, thus in accordance with FIG. 6 for slab support lengths L=17.5 m the characteristic curve 28 and for slab support lengths L=21.5 m the characteristic curve 31.

The uppermost characteristic curves applying for a specific slab support length L correspond with the previous speed factors K_upperLimit given in the tables. In concrete terms characteristic curve 28 corresponds to a speed factor K of 48900 and characteristic curve 31 to the speed factor K of 60300. The characteristic curves 28 and 31 thus correspond to rapidly solidifying steel qualities, which while adhering to standard quality criteria, allow a high casting velocity and heat dissipation.

The lowest characteristic curves according to FIG. 6 applying for a specific slab support length L (for slab support lengths L=17.5 m: characteristic curve 30; for slab support length L=21.5 m: characteristic curve 33) correspond to the speed factors K_lowerLimit listed in the table.

The steel qualities corresponding to characteristic curves 32 and 33, because of their slower solidification, are not able to be cooled so "hard", i.e. not so quickly, as a steel quality corresponding to the characteristic curve 31. Likewise the steel qualities corresponding to the characteristic curves 29 and 30 are not able to be cooled so quickly as a steel quality corresponding to the characteristic curve 28.

The cooling speed decisively determines the position of the liquidus tip within the slab 3. Casting velocity ranges lying above the steel quality-specific characteristic curves 28-31 are to be avoided, in order to avoid bulging and cracking of the slab 3 in the area of the liquidus tip. In other words the characteristic curves 28-31 represent limit casting velocity curves for different sorts of steel.

In an operational management identical to the starting point of an arrow 31' in FIG. 6, with a casting velocity $v_c$=6.5 m/min and a slab thickness d=104.5 mm, the liquidus tip of the slab 3 would lie for example at the end of the slab-guiding device 6, i.e. as close as possible to the entry into the roughing train 4, through which an optimum utilization of the casting heat is guaranteed for the subsequent rolling process. If now, as shown by arrow 31' by way of example, the casting velocity $v_c$ is reduced for operational reasons to 5 m/min, in accordance with arrow 31", the slab thickness d would be raised to approximately 110 mm, in order to continue to keep the liquidus tip of the slab 3 at the end of the slab-guiding device 6 and to guarantee an optimum utilization of the casting heat for the subsequent rolling process.

Conversely, for an increase in the casting velocity $v_c$ (e.g. after operational problems have been rectified which have made it necessary to temporarily throttle the casting velocity $v_c$) the slab thickness d must be reduced accordingly.

The operational reasons which make it necessary to reduce the casting velocity $v_c$ can for example involve irregularities detected by sensors in the area of the pusher or the die, especially on the bath level of the die, or deviations of the slab temperature from prespecified values.

A change in the slab thickness d can occur by a previously described dynamic LCR thickness reduction by means of the LCR guide segment 16'.

If the casting speed $v_c$ falls as a result of the circumstances given above, the operational team will be notified by an output device to reduce the Liquid Core Reduction (LCR) so that the slab thickness d increases, and by doing so to reach the conditions for a respective corridor range again. In such cases an upper range of the corridor may be the desired objective.

Depending on what are seen by the operators as the main parameters of the plant (the slab thickness d or the casting velocity $v_c$), starting from a desired slab thickness d a corresponding target casting velocity $v_c$ can be selected or the slab thickness d can be varied accordingly, starting from a desired casting velocity $v_c$.

It should be noted that, in the interests of high operational stability, the changes of the slab thickness d described above are only carried out for relevant changes of the casting velocity $v_c$ (e.g. for changes of $v_c$ by around 0.25 m/min) and not for any slight deviation of the casting velocity $v_c$ from a desired casting velocity in each case.

To comply with the characteristic curves or with the corresponding speed factors K, as the casting speed $v_c$ decreases, the slab thickness d can be increased and thereby the material throughput increased and thus optimized.

Since a casting velocity $v_c$ above approximately 7 m/min are barely accessible for stable casting, this range has been excluded from the diagram in accordance with FIG. 6.

What is claimed is:

1. A method for continuous or semi-continuous production of hot steel strip, comprising:

casting a slab by guiding the slab through a slab-guiding device, feeding the slab directly to a roughing train;

rolling the slab in the roughing train to an intermediate strip within a period of at most 80 seconds in at least four passes using at least four roughing stands, and further rolling the slab in a finish rolling train to a final strip, wherein the slab guiding device performs a Liquid Core Reduction method to reduce the thickness of the slab from an initial thickness in the range 105 to 130 mm, while the slab has a liquid cross-sectional core, to a slab thickness of between 95 and 120 mm, wherein a slab support length measured between an end of the slab-guiding device facing a meniscus and the roughing train is greater than or equal to 18.5 m, wherein a casting velocity lies in a range of 3.8-7 m/min, and wherein slabs are cast as a function of the following casting velocities:

for casting velocities between 3.8 and 5.0 m/min, a slab thickness between 100-120 mm, for casting velocities between 5.0 and 5.9 m/min, a slab thickness between 95-110 mm, and for casting velocities greater than or equal to 5.9 m/min, a slab thickness between 95-102 mm, and heating the intermediate strip emerging from the roughing train by an inductive heating device using a cross field heating method starting from a temperature above 770° C. and ending at a temperature of at least 1110° C.

2. The method of claim 1, wherein the first rolling pass in the roughing train occurs within at most 7 minutes from the start of solidification of the liquid slab present in the die.

3. The method of claim 1, wherein, between the end of the slab-guiding device and an entry area of the roughing train only cooling of the slab resulting from an ambient temperature is allowed.

4. The method of claim 1, wherein in the roughing train there is a reduction of the thickness of the slab by 35-60%.

5. The method of claim 1, wherein the intermediate strip emerging from the roughing train is cooled at a cooling rate of a maximum of 3 K/m.

6. The method of claim 1, wherein the intermediate strip is heated up within a period of 4 to 25 seconds.

7. The method of claim 1, wherein when precisely four rolling passes are performed in the roughing train, there is provision for the elapsed time between the first rolling pass and the entry into the heating device for intermediate strip thicknesses of 5-10 mm, not to amount to longer than 105 seconds.

8. The method of claim 1, wherein the heated intermediate strip is finished in the finish rolling train in four rolling passes, using four finishing stands or in five rolling passes using five finishing stands to a final strip with a thickness of less than 1.5 mm.

9. The method of claim 8, wherein the rolling passes carried out within the finish rolling train occur within a period of a maximum of 16 seconds.

10. The method of claim 1, wherein for LCR thickness reduction of slab, predefined guide elements of the slab-guiding device are adjustable relative to the longitudinal axis of the slab for making contact with the slab, wherein the guide elements are adjusted as a function of at least one of the material of the slab and the casting velocity.

11. The method of claim 10, wherein the slab thickness adjustable quasi-statically after the beginning of a casting sequence.

12. The method of claim 10, wherein the slab width is dynamically adjustable by any given amount during the casting process or during the passage of the slab through the slab-guiding device.

13. The method of claim 1, wherein for particular steels cooled by applying 3 to 4 liters of coolant per kg of slab steel in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in a range of 42000 to 48900, while the speed factor for a slab support length of 23 m, lies in a range of 55200 to 64600, wherein to determine casting velocities $v_c$ for plants with slab support lengths lying between the slab support lengths of 17.5 m and 23 m, an interpolation is performed between the ranges.

14. The method of claim 1, wherein for particular steels cooled by application of 2 to 3.5 liters of coolant per kg of slab steel in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in a range of 39600 to 46500, while the speed factor for a slab support length of 23 m lies in a range of 52100 to 61900, wherein for determining casting velocities slab thicknesses for plants with slab support lengths lying between the slab support lengths or 17.5 m and 23 m, an interpolation is performed between the ranges.

15. The method of claim 1, wherein for particular steels cooled by application of less than 2.2 liters of coolant per kg of slab steel in a stationary-continuous operation of the plant, the relationship of a slab thickness measured in [mm] to the casting velocity measured in [m/min] is adhered to in accordance with the formula $v_c=K/d^2$, wherein $v_c$ is the casting velocity, d is the slab thickness, and K is a speed factor, wherein the speed factor K for a slab support length of 17.5 m lies in a corridor range of 37100 to 44100, while the speed factor for a slab support lengths of 23 m lies in a corridor range of 48900 to 59000, wherein for determining casting velocities slab thicknesses for plants with slab support lengths lying between the slab support lengths of 17.5 m and 23 m, an interpolation is performed between the ranges.

16. A plant for carrying out a method for continuous or semi-continuous production of hot steel strip, comprising:

a die, a slab-guiding device downstream of the die, a roughing train positioned directly after the slab-guiding device downstream of the slab-guiding device, the roughing train comprising four or five roughing stands, an inductive heating device downstream of the roughing train, and a finish rolling train downstream of the inductive heating device, wherein the slab-guiding device has a series of lower guide elements and a series of upper guide elements disposed in parallel or converging therewith, and a receiving shaft is for receiving a slab emerging from the die is provided between the two guide element series, which by embodying different distances between opposing guide elements to one another in the transport direction of the slab, is narrowed at least in sections, thereby reducing the thickness of the slab, wherein the clear receiving width of the receiving shaft at its input area pointing towards the die is between 105 and 130 mm, wherein the receiving shaft at its end pointing towards the roughing train has a clear receiving width corresponding to the slab thickness of the slab of between 95 and 120 mm, wherein a slab support length measured between the meniscus and the end of the receiving shaft of the slab-guiding device facing towards the roughing train is greater than or equal to 18.5 m, wherein a control device is configured to maintain the casting velocity of the slab in a range between 3.8-7 m/min, wherein the heating device comprises an inductive cross-field heating oven configured to heat the slab from a temperature of above 770° C. to a temperature of at least 1110° C., and wherein no cooling device is provided between the end of the receiving shaft or of the slab-guiding device and a feed area of the roughing train, but a thermal cover is provided, which at least partly surrounds sections of a conveyor device for the transport of the slab.

17. The plant of claim 16, wherein roughing stands disposed in the roughing train are configured to perform a reduction of the thickness of the slab by respectively 35-60% per roughing stand to produce intermediate strip with a thickness of 3 to 15 mm.

18. The plant of claim 16, wherein the finish rolling train comprises four finishing stands or five finishing stands configured to reduce an intermediate strip emerging from the roughing train to a final strip with a thickness of less than 1.5 mm.

19. The plant of claim 18, wherein the finishing stands are each disposed at distances of less than 7 m from one another, wherein the distances are measured between the working roller axes.

20. The plant of claim 16, wherein, for reducing the thickness of the slab, specific guide elements are adjustable and through this a clear receiving width of the receiving shaft is able to be reduced or enlarged, wherein the slab thickness or the clear receiving width is able to be adjusted as a function of at least one of the material of the slab and the casting velocity.

21. The plant of claim 20, wherein the adjustable guide elements are disposed in a front half of the longitudinal extent of the slab-guiding device facing towards the die.

22. The plant of claim 16, wherein a working roller axis of the first roughing stand of the roughing train closest to the slab-guiding device is disposed at a maximum of 7 m after the end of the slab guiding device.

23. The plant of claim 16, wherein an entry end of the heating device facing towards the roughing train is disposed at a maximum of 25 m after the operating roller axis of the roughing stand closest to the heating device.

* * * * *